US005502472A

United States Patent [19]

Suzuki

[11] Patent Number: 5,502,472

[45] Date of Patent: Mar. 26, 1996

[54] DROPLET JET APPARATUS

[75] Inventor: Masahiko Suzuki, Nagoya, Japan

[73] Assignee: Brother Kogyo Kabushiki Kaisha, Nagoya, Japan

[21] Appl. No.: 154,108

[22] Filed: Nov. 17, 1993

[30] Foreign Application Priority Data

Feb. 16, 1993 [JP] Japan ..... 5-026855

[51] Int. Cl.[6] ..... B41J 2/045

[52] U.S. Cl. ..... 347/69

[58] Field of Search ..... 347/68, 69, 20

[56] References Cited

U.S. PATENT DOCUMENTS

| | | | |
|---|---|---|---|
| 4,879,568 | 11/1989 | Bartky et al. | 347/69 |
| 4,887,100 | 12/1989 | Michaelis et al. | 347/69 |
| 5,016,028 | 5/1991 | Temple | 347/69 |
| 5,248,998 | 9/1993 | Ochiai et al. | 347/69 |
| 5,252,994 | 10/1993 | Narita et al. | 347/69 X |

FOREIGN PATENT DOCUMENTS

| | | |
|---|---|---|
| 0364136 | 4/1990 | European Pat. Off. . |
| 0513971 | 11/1992 | European Pat. Off. . |
| 1038244 | 2/1989 | Japan . |
| 1287977 | 11/1989 | Japan . |
| WO92/22429 | 12/1992 | WIPO . |

*Primary Examiner*—Benjamin R. Fuller
*Assistant Examiner*—Alrick Bobb
*Attorney, Agent, or Firm*—Oliff & Berridge

[57] ABSTRACT

A droplet jet apparatus using an actuator serves as an electromechanical transducer that acts as an energy generator used for the ejection of droplets. The actuator has a plurality of grooves and walls made of piezoelectric material that define liquid channels and pressure chambers. Drive electrodes are formed on both sides of each wall. The drive electrodes formed on both sides of each piezoelectric wall fall within an electrode depth range of ±30% or less with respect to a set value of an electrode depth d extending in the wall height direction. Thus, the droplets can be stably jetted for a long period of time by setting the electrode depth to a proper value.

15 Claims, 9 Drawing Sheets

| No. | DEPTH OF ELECTRODE(μm) | | MAXIMUM DISPLACEMENT | VOLUME VARIATION |
|---|---|---|---|---|
| | LEFT | RIGHT | | |
| 1 | 250 | 250 | 100 | 100 |
| 2 | 150 | 150 | 94 | 74 |
| 3 | 175 | 175 | 99 | 94 |
| 4 | 200 | 200 | 100 | 98 |
| 5 | 225 | 225 | 100 | 99 |
| 6 | 275 | 275 | 99 | 100 |
| 7 | 300 | 300 | 95 | 96 |
| 8 | 325 | 325 | 92 | 93 |
| 9 | 350 | 350 | 86 | 67 |
| 10 | 225 | 275 | 98 | 99 |
| 11 | 200 | 300 | 93 | 97 |
| 12 | 175 | 325 | 92 | 93 |
| 13 | 150 | 350 | 90 | 63 |

DROPLET JET APPARATUS

BACKGROUND OF THE INVENTION

1. Field of the Invention

The present invention relates to a structure of a droplet jet apparatus and, more specifically, to drive electrodes each formed on an actuator used as an energy transducer used for the ejection of droplets.

2. Description of the Related Art

Various droplet ejecting devices or jet apparatus using energy transducers have heretofore been developed for various applications such as ink-jet printers and put to practical use. Electrothermal transducers, such as a heating element, and electromechanical transducers, such as a piezoelectric material, are used as energy transducers employed in such droplet jet apparatus. A droplet jet apparatus using piezoelectric material in general has an advantage because restrictions are less on available liquid to be heated and there is a wide range of choices of the liquid as compared with an apparatus using a heating element. However, various problems arise in such apparatus in that a droplet jet apparatus using a piezoelectric element or actuator used as an electromechanical transducer has a low degree of integration compared with an apparatus using an electrothermal transducer wherein a semiconductor manufacturing process can be applied and a size reduction in the droplet jet apparatus is required. In droplet jet apparatus using a piezoelectric body as an energy transducer, an actuator or piezoelectric element is used having mainly piezoelectric and electrostrictive transversal effects, which is a so-called unimorph piezoelectric element or bimorph piezoelectric element.

A droplet jet apparatus designed to bring a piezoelectric element or actuator used as an energy transducer into high integration has been disclosed in U.S. Pat. Nos. 4,879,568, 4,887,100, and 5,016,028.

In these devices, a small-sized droplet jet apparatus is used that has a plurality of grooves (channels) serving as liquid channels and pressure chambers. The pressure chambers are defined in a piezoelectric material subjected to polarization processing along its thickness direction in a high-integration rate. Drive electrodes are formed on both sides of each of the walls made of piezoelectric materials for separating the respective grooves (channels) from each other to produce any piezoelectric and electrostrictive effects. The produced effects make a transformation of a shear mode and produce a pressure change in each groove (channel), thereby ejecting or jetting desired droplets from respective nozzles of a nozzle plate provided in front of the droplet jet apparatus.

However, in the droplet jet apparatus having the structure disclosed in the above publications, a detailed description is hardly made as to the drive electrodes formed on both sides of each wall made of piezoelectric material. Accordingly, many problems arose as to the design of the droplet jet apparatus in practice. Thus, it was very problematic to put the above-type droplet jet apparatus having stable droplet ejection characteristics to practical use.

SUMMARY OF THE INVENTION

A primary object of the present invention is to provide a droplet jet apparatus having the stable above-described structure by employing various parameters determined to drive the electrodes formed on both sides of the piezoelectric walls to result in a satisfactory droplet ejection.

According to one aspect of the present invention, a droplet jet apparatus uses a piezoelectric element or actuator as an electromechanical transducer that acts as an energy generator for the ejection of droplets. The actuator comprises a plurality of grooves with walls that define liquid channels and pressure chambers in piezoelectric material. Drive electrodes are formed on both sides of each wall having an electrode depth range of ±30% or less of a set value of an electrode depth d extending in the direction of the height of each wall.

In operation of the drive electrodes, a voltage is first applied to or across the drive electrodes formed on portions of both sides of each wall made of the piezoelectric material based on a signal inputted from an external source according to a printing pattern. Referring to one wall for explanation, one side of the wall acts as a positive electrode whereas the other side thereof acts as a negative electrode. According to the droplet jet apparatus of the present invention, the drive electrodes have electrode layers with an electrode depth extending in the wall height direction of ±30% or less of the set value. The electrode layers are formed on portions of both sides of each wall, and they momentarily deform each wall within a suitable time interval in response to a drive signal corresponding to the external signal.

As is apparent from the above description, the droplet jet apparatus of the present invention is constructed such that the drive electrodes formed on the sides of each piezoelectric wall are set to fall within the range of ±30% or less of the set value of the electrode depth d extending in the wall height direction. Therefore, the piezoelectric wall can be efficiently and stably deformed in a moment by the application of the drive voltage across the drive electrodes, thereby enabling the stable ejection of the droplets.

The above and other objects, features and advantages of the present invention will become apparent from the following description and the appended claims, taken in conjunction with the accompanying drawings in which a preferred embodiment of the present invention is shown by way of illustrative example.

DETAILED DESCRIPTION OF PREFERRED EMBODIMENTS

The present invention will hereinafter be described in detail with reference to the accompanying drawings in which a specific embodiment is shown by way of illustrative example.

Figure 1:
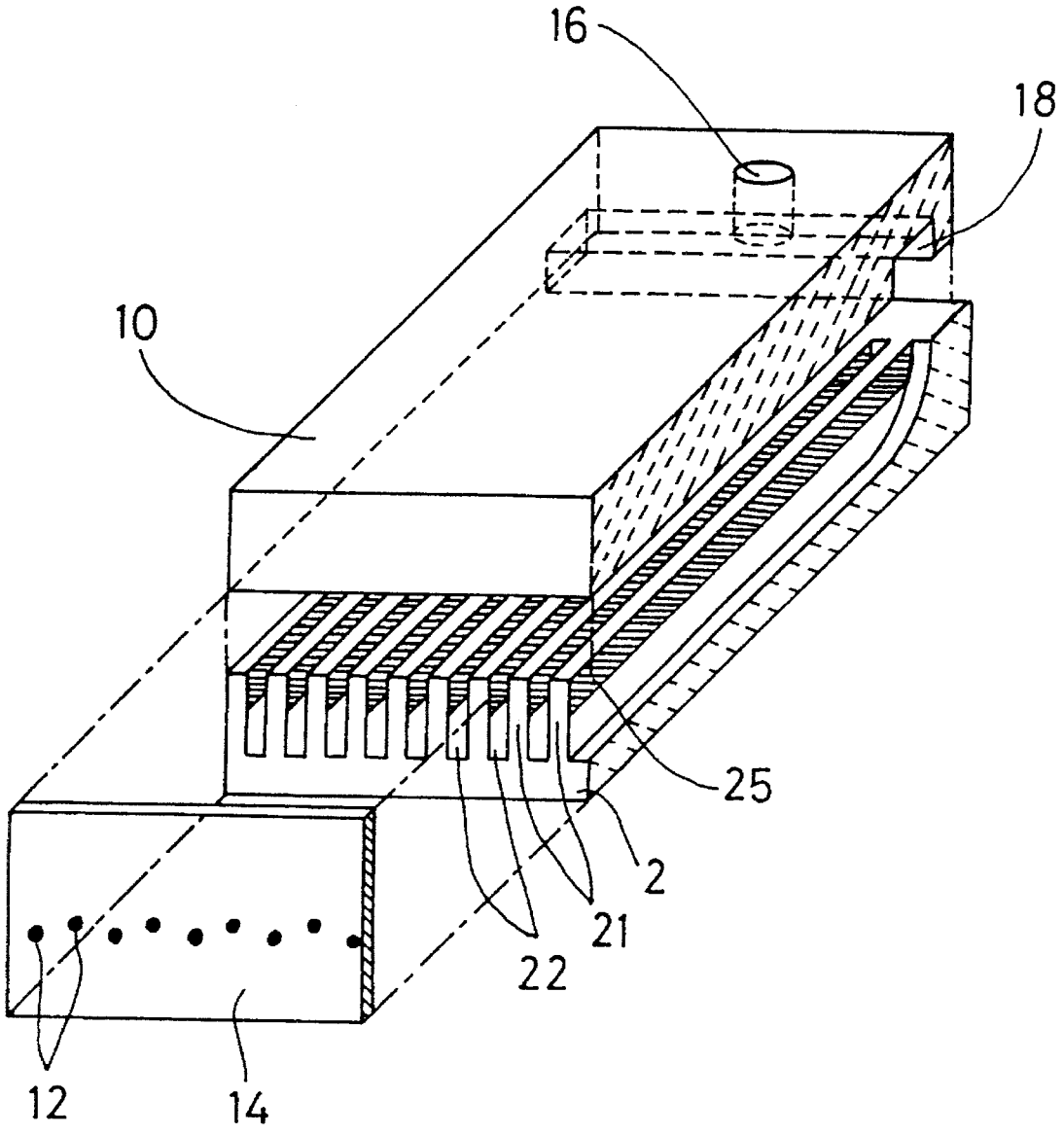
FIG. 1 is a partial exploded side view in section showing the structure of a droplet jet apparatus in one embodiment according to the present invention.

FIG. 1 is a view schematically showing the structure of a droplet ejecting device or jet apparatus according to the present invention. The droplet jet apparatus includes a plurality of grooves 22 that act as ink channels and pressure chambers for the ejection of droplets of ink. An actuator 2 comprises a plurality of walls 21 each having drive electrodes 25 formed on portions of both sides thereof and are respectively made of piezoelectric materials. A cover plate 10 is bonded to the actuator 2 and has an ink induction hole 16 and an ink manifold 18 both defined therein. A nozzle plate 14 is bonded to the actuator 2 and has a plurality of nozzles 12 defined therethrough for ejecting or jetting the droplets of the ink therefrom. Each of the drive electrodes 25 is made up of various metals such as Al, Cr, Ni and Cu and noble metals such as Au and Pt or an alloy of various metals. An electrode layer is constructed in the form of either a single layer or a layered body or board with a plurality of layers.

Figure 2:
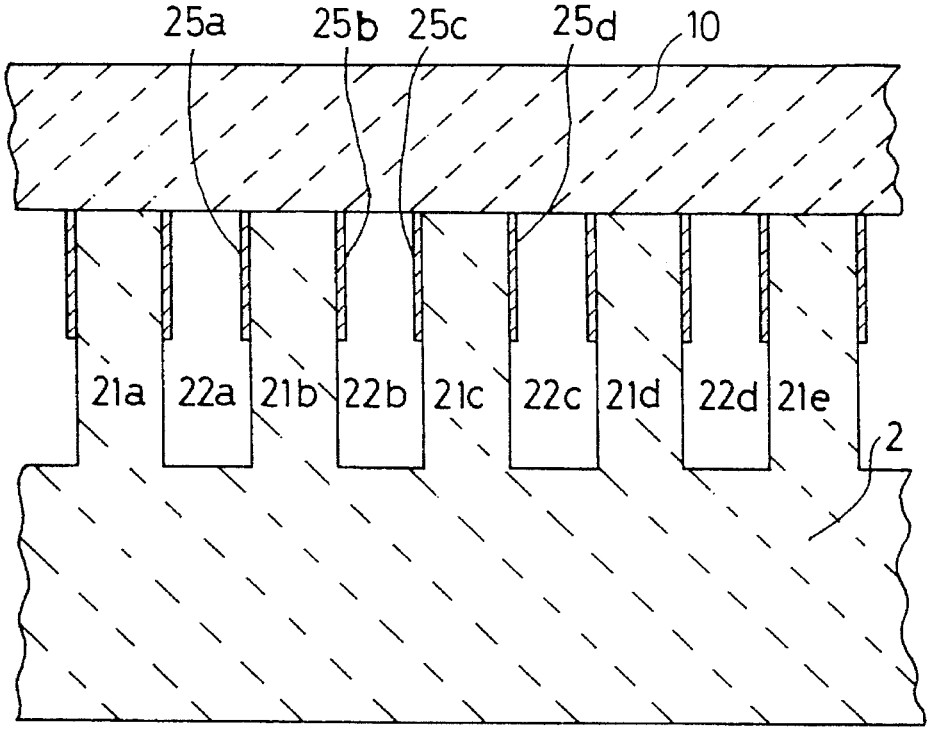
FIG. 2 is an enlarged partial cross-sectional view showing the walls and grooves of the droplet jet apparatus shown in FIG. 1.
Figure 3:
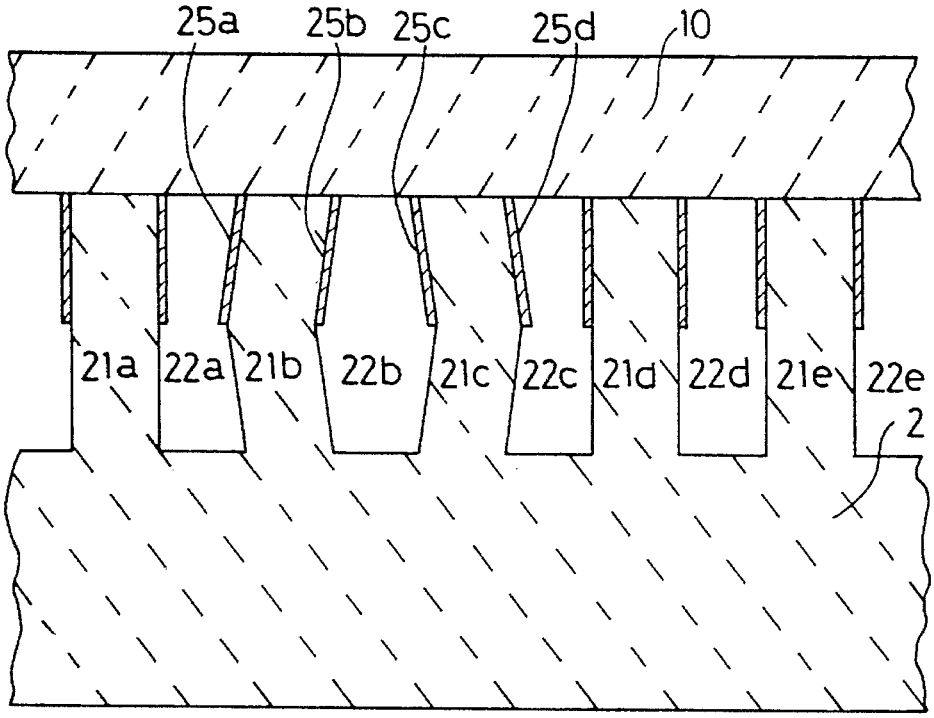
FIG. 3 is an enlarged partial cross-sectional view illustrating the walls and the grooves of the droplet jet apparatus shown in FIG. 1 when voltage has been applied.

FIGS. 2 and 3 describe respective operations or behaviors made upon application of a voltage across the drive electrodes 25. FIG. 2 shows the state of the walls 21 made of the piezoelectric material and the grooves 22 when the voltage is not applied across the electrodes 25. FIG. 3 shows the state of the walls 21 and the grooves 22 when the voltage is applied across the drive electrodes 25. When the voltage is not applied across the drive electrodes 25 as shown in FIG. 2, the piezoelectric walls 21*a* through 21*e* are not deformed and all the grooves 22*a* through 22*d* are identical in capacity or volume to each other. When the voltage is applied across the drive electrodes, with the drive electrodes 25*b*, 25*c* and 25*a*, 25*d* respectively regarded as positive electrodes and negative electrodes, the walls 21*b* and 21*c* are deformed and the volume of the groove 22*b* increases as shown in FIG. 3. Further, the volume of each of the grooves 22*a* and 22*c* decreases. When the applied voltage is removed from the state shown in FIG. 3, the walls 21*b* and 21*c* return to the state illustrated in FIG. 2. At this time, pressure is exerted on liquid in the groove 22*b* to thereby eject its droplets. At this point, the time required to deform the wall 21 is of importance to stably eject the droplets. It is thus necessary to deform the wall 21 within a short time interval less than or equal to several μ secs.

Figure 4:
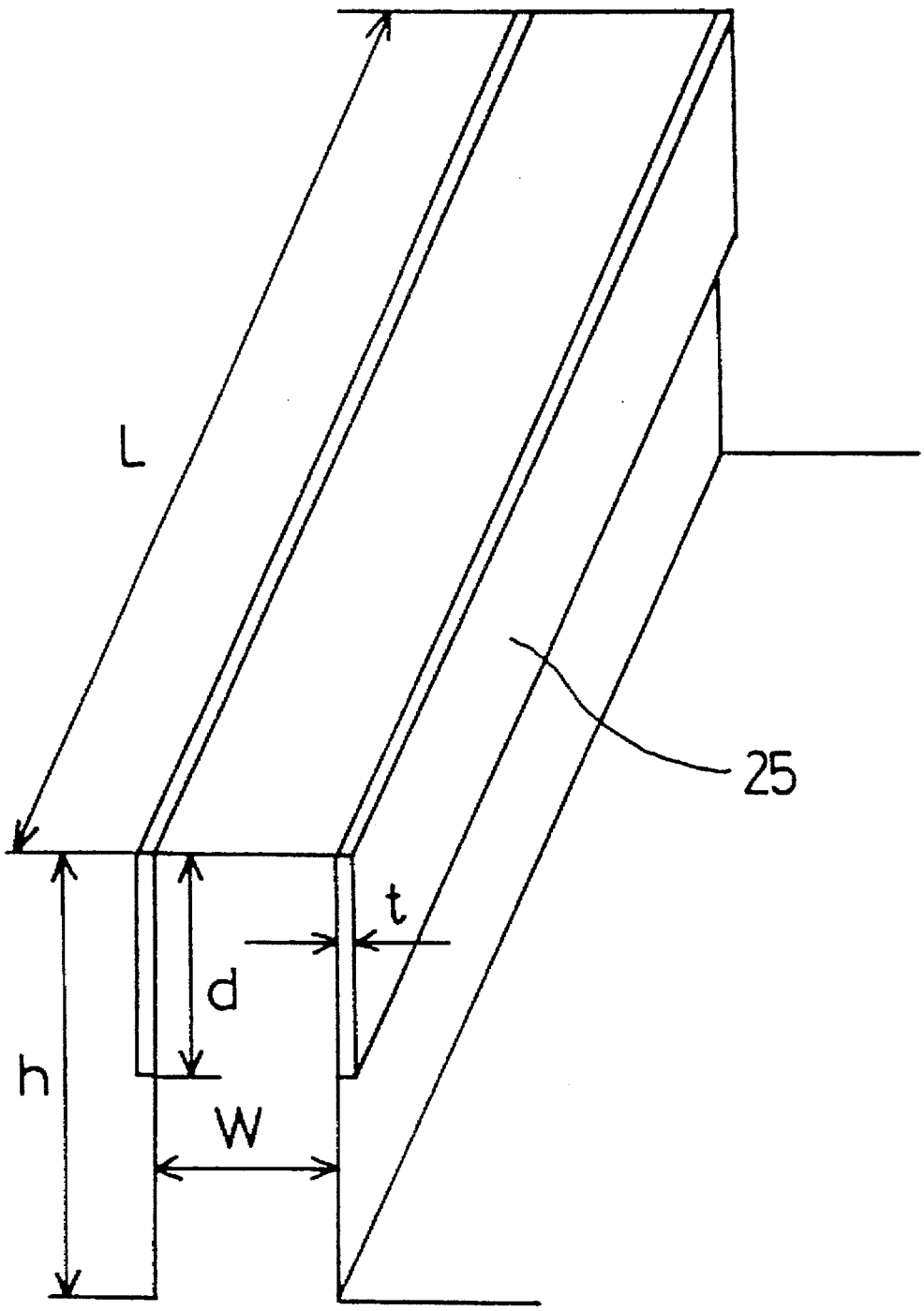
FIG. 4 is a perspective view showing the walls made of a piezoelectric material and the drive electrodes employed in the droplet jet apparatus shown in FIG. 1.

Next, the following experiments were conducted to determine a proper range of thickness of each drive electrode. FIG. 4 is a perspective view showing the wall 21 made of the piezoelectric material and the drive electrodes 25. In FIG. 4, the width, height and length of the wall 21 are represented by w, h and L, respectively. Further, the thickness of each drive electrode 25 is represented by t and the depth of each drive electrode 25, which extends in the direction of height of the wall, is represented by d.

Figure 5:
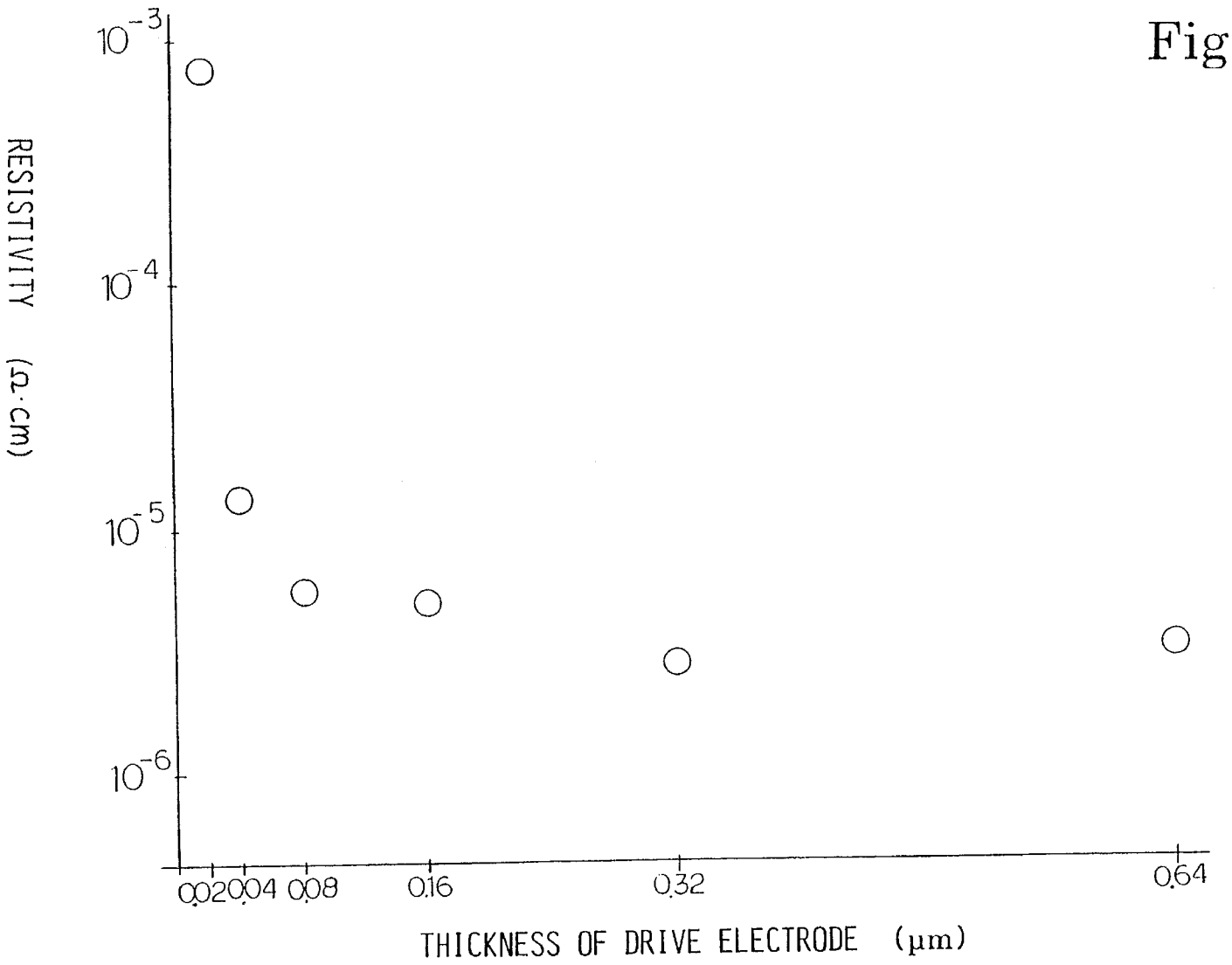
FIG. 5 is a graph describing the relationship between the thickness of each drive electrode and the resistivity.

In order to determine the minimum thickness allowable for each drive electrode from the experiments, walls made of piezoelectric ceramic materials, each having a w of 0.1 mm, an h of 0.5 mm and an L of 8 mm, were first prepared. Then, nickel electrodes having thicknesses t of 0.02 μm, 0.04 μm, 0.08 μm, 0.16 μm, 0.32 μm and 0.64 μm were formed on corresponding sides of the walls by a dry process such as a sputtering process or metallizing. Thereafter, the resistivity of each drive electrode was measured. FIG. 5 shows the result of this measurement. When the thickness t of the drive electrode is less than or equal to 0.04 μm, a great increase in resistivity occurs as is apparent from FIG. 5. As it is unlikely that the quality of film of each nickel electrode has deteriorated, such an increase in resistivity is attributal to the fact that the electrical continuity of the electrode film formed on the surface of each piezoelectric ceramic wall is lost or impaired.

Figure 6:
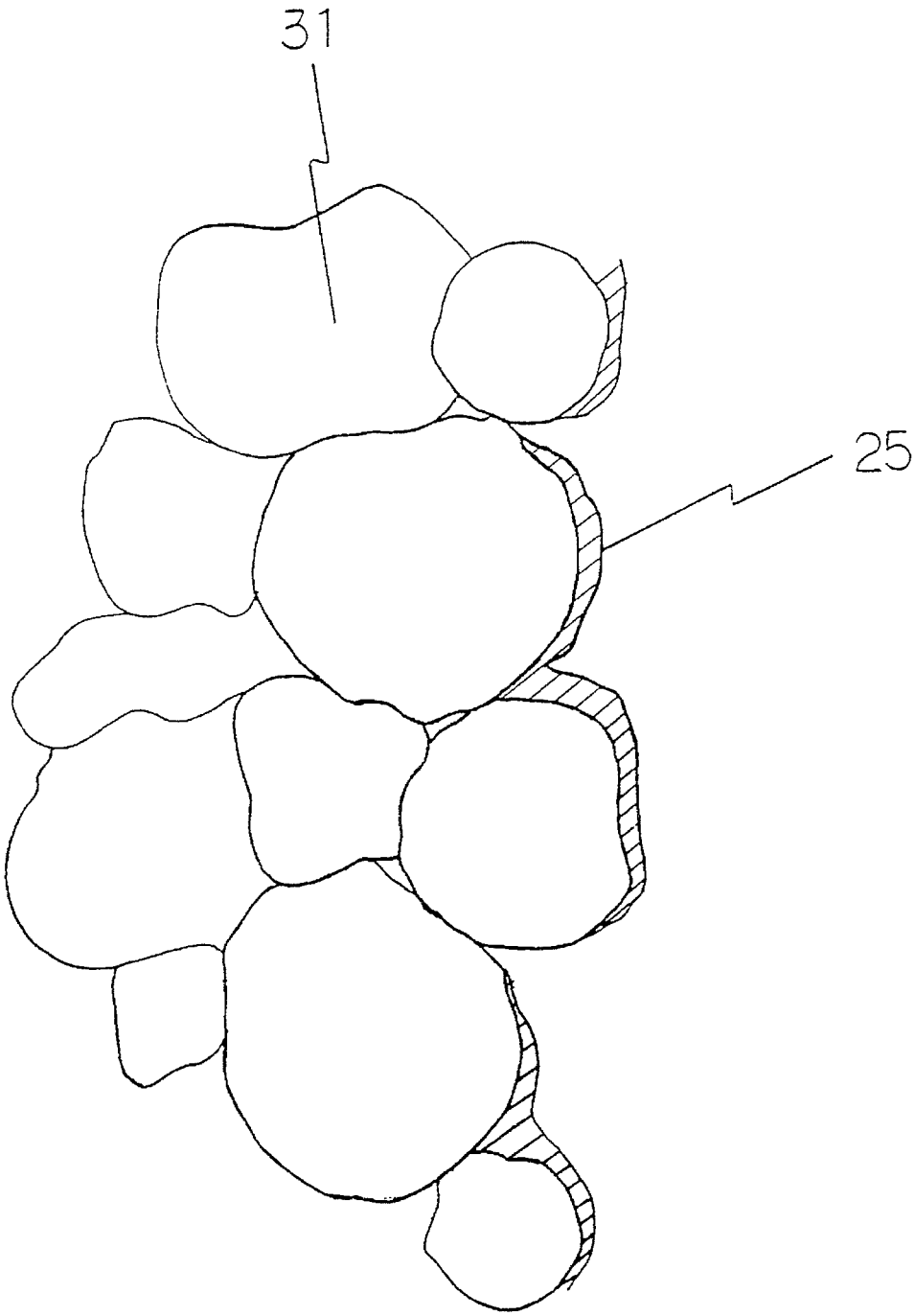
FIG. 6 is an enlarged schematic view showing the concept of the electrodes formed on each wall made of the piezoelectric material employed in the droplet jet apparatus shown in FIG. 1.

FIG. 6 shows the concept of the drive electrodes formed on each wall. A PZT piezoelectric ceramic material is normally used as the material for the actuator of the droplet jet apparatus according to the present invention. The piezoelectric ceramic material is normally of a polycrystalline sintered material and comprises crystal particles or grains 31 each having an average diameter of 1 μm to 5 μm. Further, the piezoelectric ceramic material has holes defined therein in a several percent range substantially identical in size to each other. That is, an irregularity of 2 μm or so appears on the surface upon which the drive electrodes are formed. The drive electrodes 25 formed on such an irregular surface provide a significant electrical discontinuity as shown in FIG. 6. The thinner each drive electrode 25 is formed, the more its electrical discontinuity increases. It was determined from experimentation that when the thickness of each drive electrode 25 reaches a value less than or equal to about 0.04 μm, the apparent resistivity increases. Thus, the minimum thickness allowable for each drive electrode is determined to be 0.04 μm or so. Incidentally, the experiments were performed where the material used for each drive electrode is of aluminum. However, similar results could be obtained with nickel.

On the other hand, the piezoelectric material electrically serves as a capacitor from the view of a circuit configuration where the time required to deform the piezoelectric wall at activation is considered. An electrical time constant $\tau$ related to the deformation time of the wall is given by $\tau = C \cdot R$, where C represents the capacitance of the piezoelectric material and R represents the resistance of each drive electrode. When the thickness of the drive electrode is made thick, a decrease in a cross-sectional area $t \times d$ of each drive electrode and an increase in resistance R occur, as well as the occurrence of an increase in apparent resistivity as is apparent from the results of the experiments. Further, a margin taken to an allowable time constant necessary for the ejection of the droplets is reduced and a large load is exerted upon design of a drive circuit. It is therefore preferable that the thickness of each drive electrode is not too thick.

Thus, the thickness of each drive electrode has been set to 0.04 μm or greater in the droplet jet apparatus according to the present embodiment. As a result, the droplet jet apparatus capable of stably ejecting droplets therefrom is obtained.

Figure 7:
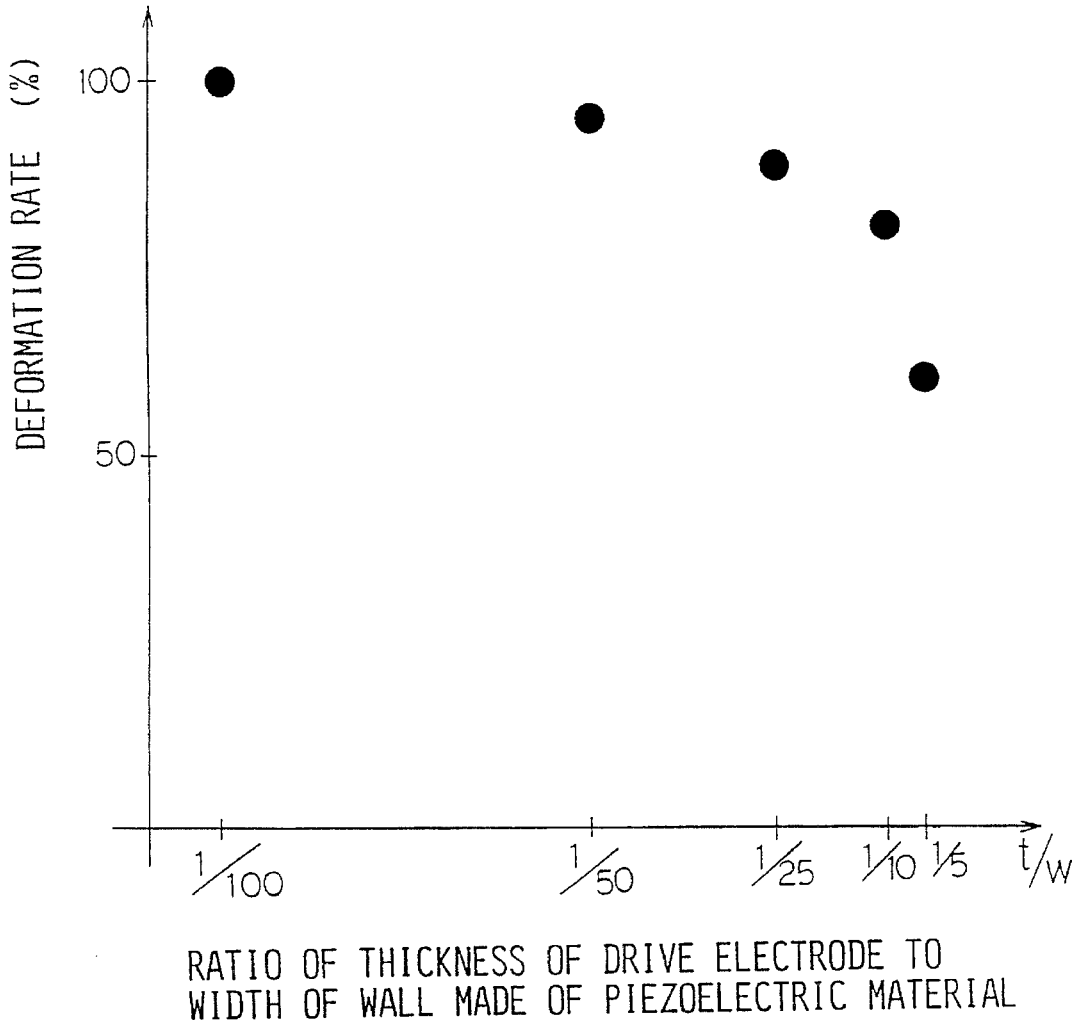
FIG. 7 is a graph describing the relationship between the thickness of each drive electrode and the rate of deformation.

To determine the maximum thickness allowable for each drive electrode from the experiments, walls made of piezoelectric ceramic materials, each having a w of 0.05 m, an h of 0.2 mm and an L of 8 mm, were first prepared. Then, nickel electrodes having thicknesses t of 0.5 μm, 1 μm, 2 μm, 5 μm and 10 μm were formed on both sides of the walls by a dry process such as a sputtering process or metallizing. Thereafter, samples of the walls were made having ratios t/w of the thicknesses of the drive electrodes to the widths of the walls respectively 1/100, 1/50, 1/25, 1/10 and 1/15 . After the cover plate was bonded to the samples, a pulse voltage of 50 V was applied to the samples and the degree or rate of deformation of each wall and its displacement were measured by a laser displacement gauge. The results obtained by successively plotting data about the thicknesses of the respective drive electrodes are shown in FIG. 7. The results of the measurement by the laser displacement gauge are arranged according to a variation in volumes of the adjacent grooves and the volume variation when the thickness of each drive electrode is 0.5 μm (t/w=1/100) represented as 100%.

As is apparent from FIG. 7, the rate of deformation of each wall is reduced when the sample in which the ratio t/w of the thickness of each drive electrode to the width of each wall made of the piezoelectric material is 1/5 is used. This is because when electrode materials different in Young's modulus from the piezoelectric material are formed as a drive electrode layer, they have a slight influence on the deformation of each wall made of the piezoelectric material when the thickness of each drive electrode is made thin. However, when the drive electrode has a thickness made thick, the different electrode materials influence the deformation of each wall. When the electrode layer is made thick, a problem also arises as a matter of course that the residual stress within a film of the electrode layer and on the interface between the film and the piezoelectric material increases. Accordingly, the strength of the film and the strength of adhesion between the film and the piezoelectric material is reduced. It is thus desirable that the maximum thickness allowable for each drive electrode is set so that the ratio r (=t/w) of the thickness of each drive electrode to the width of each wall made of the piezoelectric material is less than or equal to 1/10.

Incidentally, the experiments were performed using the material for each drive electrode as aluminum. It was however confirmed that the aluminum yielded similar results as nickel.

Accordingly, the ratio of the thickness of each drive electrode to the width of each wall made of the piezoelectric material was set to be 1:10 in the droplet jet apparatus according to the present embodiment. It was therefore possible to obtain a droplet jet apparatus capable of stably ejecting droplets therefrom.

Next, experiments were carried out on the relative density of a metal film formed for each of the drive electrodes. When the relative density is theoretically reduced, it is clear that the number of holes increases and the apparent resistivity increases. However, the resistance value is not regarded as a major problem because the allowable resistance value can be satisfied by making the thickness of each drive electrode thicker. A deterioration in corrosion resistance of the drive-electrode film due to a reduction in relative density remains a problem. In the droplet jet apparatus of the present invention, the drive electrodes 25 are exposed to the liquid (mainly ink) supplied into its corresponding groove 22. Thus, a so-called electrolytic corrosion phenomenon occurs. When the relative density is reduced, the number of open holes (connection or link holes) increases in the electrode layer and a surface area thereof held in contact with the liquid increases, thereby deteriorating the corrosion resistance. In an actual droplet jet apparatus, a protection film is formed on the surface of each drive electrode to improve the anticorrosion. However, sufficient coverage cannot be realized even if the protection film is formed on the electrode layer having a low relative density.

Figure 8:
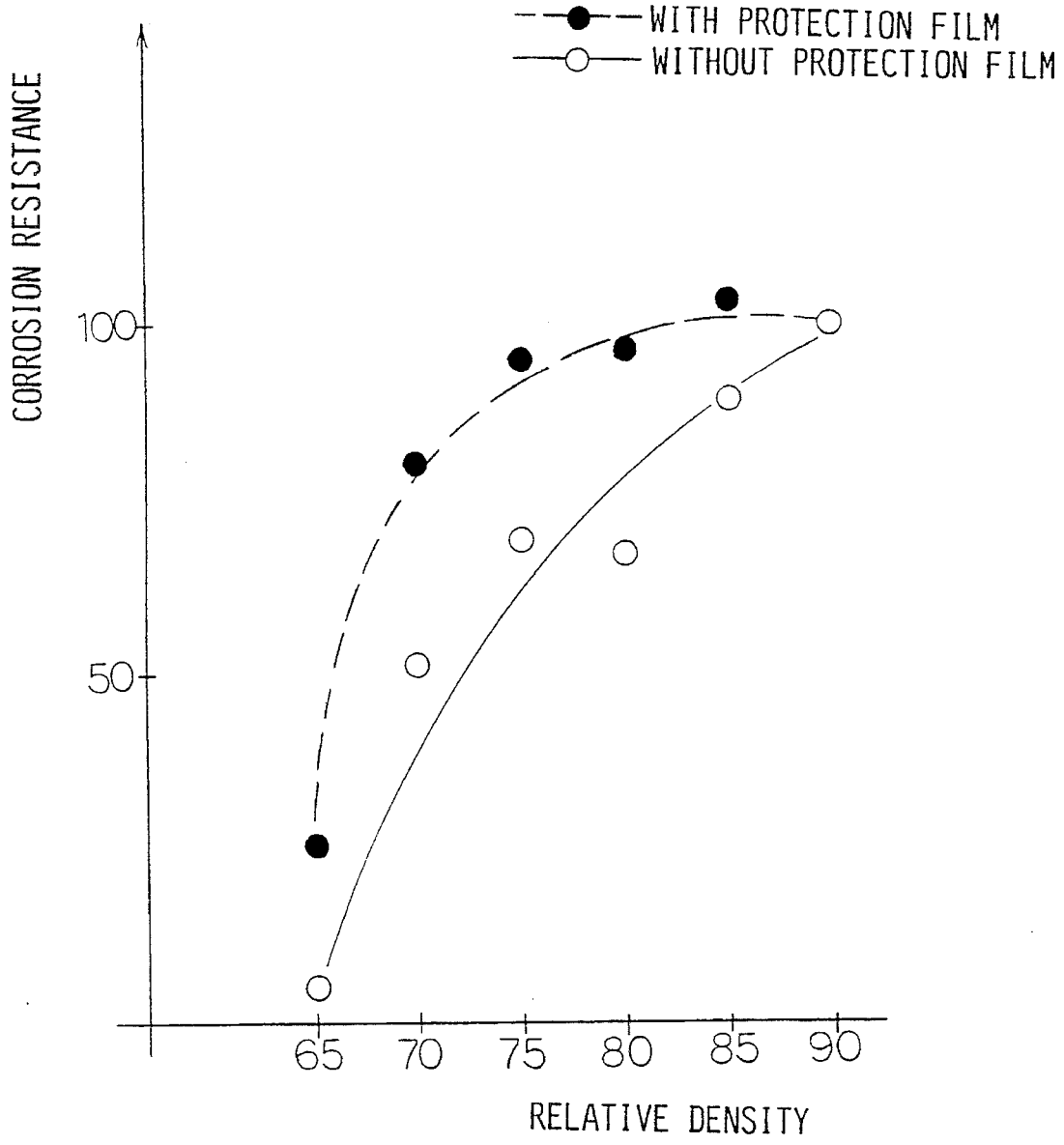
FIG. 8 is a graph describing the relationship between the relative density of each drive electrode and its resistance to corrosion.

FIG. 8 shows the relationship of the corrosion resistance vs. relative density when the corrosion resistance to salt water of a first sample formed with a nickel electrode having a thickness of about 1 μm with the relative density set as a parameter and the corrosion resistance of a similar second sample having silicon dioxide formed as a protection film on an electrode of the sample in a thickness of about 1 μm to the salt water are represented as 100%. Both samples have a relative density of 90%. The corrosion rate was measured as an evaluation item with respect to the corrosion resistance in the case of a sample having only an electrode layer. Further, the number of generated defects per unit area was measured in the case of a sample formed with a protection film. As is apparent from FIG. 8, the results of experiments show that the corrosion resistance abruptly deteriorates in the case of an electrode film whose relative density is 65% in spite of the presence or absence of the protection film. It was thus found that the minimum relative density necessary for the metal material used to form the drive-electrode film was 70%.

Accordingly, the relative density of the metal material used to form each drive-electrode film was set to reach 70% or more in the droplet jet apparatus according to the present embodiment. Therefore, the droplet jet apparatus is capable of stably injecting droplets therefrom.

Next, experiments on the purity of the metal material used to form each drive electrode were performed. When the purity is reduced, ions, which serve as impurities, increase within each electrode film. In the droplet jet apparatus of the present invention, a necessary condition or requirement is to deform each wall made of the piezoelectric material within a short period of time. In this case, a large momentary current flows in the drive electrode. When a thickness distribution exists in the drive electrode and electrical discontinuity occurs therein, a further current concentration takes place when the momentary current flows in the drive electrode. Therefore, there is a danger of the movement of impurity ions and the occurrence of migration. There is also occasionally a potential problem that the electrode film is partially broken or disconnected.

According to the experiments, aluminum having a thickness of 0.04 μm was formed on the surface of a piezoelectric ceramic material as an electrode. At this time, the experiments were performed to produce samples with 99.999%, 99.99%, 99.9%, 99% and 95% as the purities of aluminum. Under these experimental conditions, a current of 1 A was supplied to each sample for 30 minutes and a variation in the surface of each electrode was observed by a microscope before and after its supply. In the sample with 99% or more as the purity, the variation in its surface was barely observed before and after the supply of the current to the sample. However, an increase in discontinuous points of the electrode film was observed in the sample with 95% as the purity. Even when the electrical resistance of each sample was measured before and after the energization of the sample, a variation in the resistance value was only barely observed in the case of the sample with 99% or above as the purity. However, in the case of the sample with 95% as the purity, about a 15% rise in the resistance value was measured before and after its energization. As is apparent from the experimental results, it is preferable that the purity of the metal material used for each drive electrode employed in the droplet jet apparatus of the present invention is at least 99% or above. Where the purity is 99% or less, even in the case of other metals such as nickel, there appears a difference to some degree, but a variation similar to the above was observed.

Accordingly, each drive electrode was formed by the metal material with 99% or more as the purity in the droplet jet apparatus according to the present embodiment. As a result, the droplet jet apparatus capable of stably ejecting droplets therefrom was obtained.

Next, experiments on the range allowable for an average film thickness and the distribution of thickness of the formed drive electrode layer were carried out. In the droplet jet apparatus of the present invention as discussed above, a requirement is to deform each wall made of the piezoelectric material within a short period of time. In this case, a large momentary current flows in the drive electrode. When the thickness distribution exists in the drive electrode and electrical discontinuity occurs therein, a further current concentration takes place when the momentary current flows in the drive electrode. Thus, there is a danger of the movement of impurity ions in the electrode material and the occurrence of migration. There is also occasionally a potential problem that the electrode film is partially broken or disconnected.

According to the experiments, aluminum having a thickness of 0.2 μm was formed on the surface of a piezoelectric ceramic material as an electrode. At this time, samples with ±25%, ±50% and ±70% as film-thickness distributions were produced. In the experiments performed using these samples, a current of 1 A was supplied to each sample for 30 minutes and a variation in the surface of the electrode was observed by a microscope before and after its supply. In the case of the sample with ±50% or less as the film-thickness distribution, the variation in its surface was only barely observed before and after the supply of the current to the sample. However, an increase in discontinuous points of the electrode film was observed in the case of the sample with ±70% set as the film-thickness distribution. Even when the electrical resistance of each sample was measured before and after the above energization or supply, a variation in the resistance value was only barely observed in the case of the sample with 50% or less as the film-thickness distribution. However, in the case of the sample with 70% as the film-thickness distribution, about a 10% rise in the resistance value was measured before and after its energization.

As a factor for describing the above results, the fact that there is originally a drawback to the technique and condition for forming each electrode where the thickness distribution is produced ±70% upon formation of the electrode must be considered. Also important, is a difference in film quality between a thick portion of film and a thin portion of film. Therefore, the method of forming the drive electrodes by using an electrode forming technique in which a film-thickness distribution of ±50% or more of the average film thickness is used, cannot be utilized in the present invention. That is, the film-thickness distribution with respect to the average film thickness of the electrode layer is preferably ±50% or less. Although the film thickness of an edge of the formed electrode can become thinner continuously depending on the electrode forming method, such a thinned portion is not effectively exerted as the electrode on the deformation of each wall made of the piezoelectric material. It is therefore unnecessary that this is included in the above limited range.

Accordingly, the film-thickness distribution with respect to the average film thickness of the electrode layer is set to reach ±50% or less in the droplet jet apparatus according to the present embodiment. As a result, the droplet jet apparatus is capable of stably injecting droplets therefrom.

Figure 9:
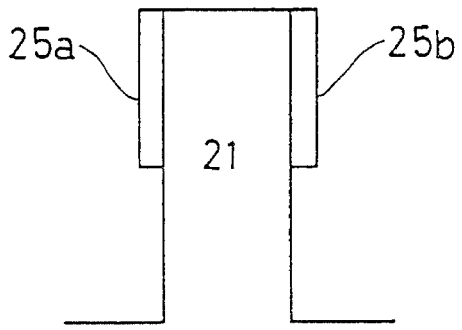
FIG. 9 is a schematic view showing the drive electrodes formed on both sides of one wall made of the piezoelectric material employed in the droplet jet apparatus shown in FIG. 1.
Figure 10:
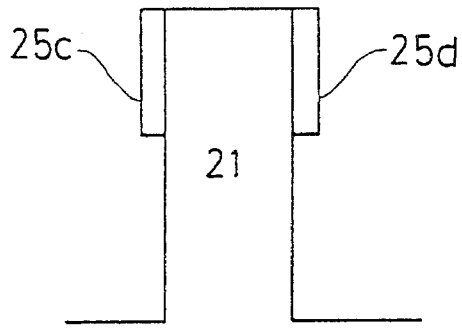
FIG. 10 is a schematic view showing another pair of drive electrodes formed on both sides of a piezoelectric wall similar to FIG. 9.
Figure 11:
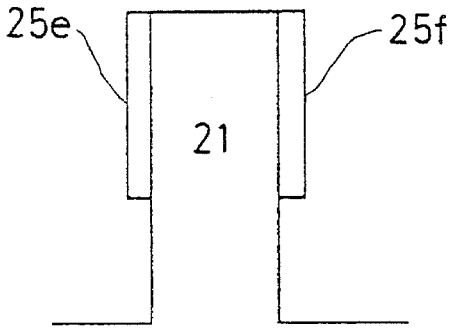
FIG. 11 is a schematic view showing another pair of drive electrodes formed on both sides of a piezoelectric wall similar to FIG. 9.
Figure 12:
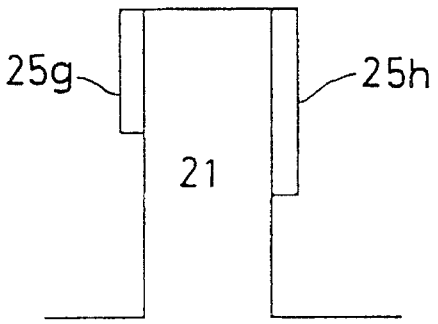
FIG. 12 is a schematic view showing another pair of drive electrodes formed on both sides of a piezoelectric wall similar to FIG. 9.

Next, experiments were carried out to determine an allowable electrode width range to a set value of depth of the formed electrode extending in the height direction of the wall made of the piezoelectric material. FIGS. 9 through 12 respectively show the depths of drive electrodes 25 formed on side faces of walls 21 made of piezoelectric materials. A set value of an electrode depth d with respect to a height h of each wall 21 made of the piezoelectric material is represented by $d=0.5 \cdot h$ as shown in FIG. 9. Accordingly, variations in electrode depth are classified into three cases as shown in FIGS. 10 through 12. FIG. 10 shows a case where the electrode depth d is shallower than the set value (i.e., $d<0.5 \cdot h$). FIG. 11 illustrates a case where the electrode depth d is deeper than the set value (i.e., $d>0.5 \cdot h$). FIG. 12 depicts a case where the depths of the left and right electrodes differ from each other.

Figures 13, 14:
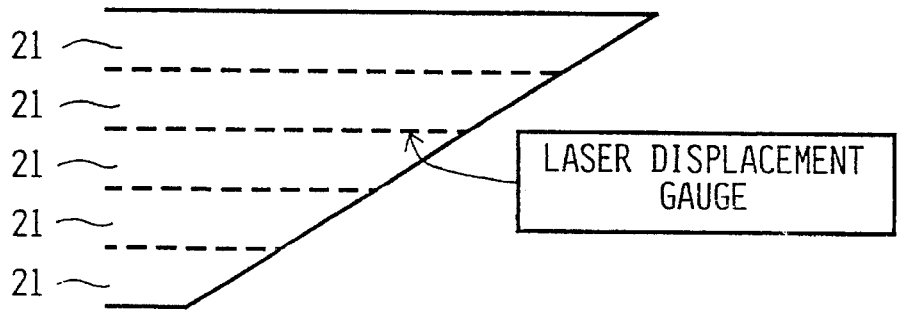
FIG. 13 is a chart explaining the relationship between the depth of each drive electrode, the maximum displacement of each wall and the rate of volume change.
FIG. 14 is a schematic view describing a method of measuring displacements of walls made of piezoelectric materials.

A wall made of a piezoelectric ceramic material, which has a width (w) of 0.1 mm, a height (h) of 0.5 mm and a length (L) of 8 mm was prepared as an experimental sample. Then, aluminum electrodes each having a thickness t of 0.64 mm were formed on the sides of the above wall by a dry process such as a sputtering process, metallizing or the like. Thereafter, samples (corresponding to those shown in FIGS. 10 and 11) having electrode depths d=150 μm, 175 μm, 200 μm, 225 μm, 275 μm, 300 μm, 325 μm and 350 μm and samples (corresponding to one shown in FIG. 12) having electrode depths d=(225, 275), (200, 300), (175, 325) and (150, 350) were fabricated on a sample having an electrode depth d of 250 μm. FIG. 13 shows the results obtained by representing data about the samples having the respective electrode depths in the form of a percentage when the maximum displacement of each wall and a variation in volume of each groove at the time when a drive voltage was applied to each sample were measured and data about the sample having the depth d=250 was set as 100.

The maximum displacement and the variation in the volume of each groove were measured in the following manner. As shown in FIG. 14, the samples to which the cover plate 10 was bonded were first diagonally cut and then subjected to a drive voltage of 50 V to deform the walls. The deformed rate or displacement of each wall was measured by a laser displacement gauge while each cut sample was scanned stepwise for each 10 μm in the wall height direction. The maximum value of the resultant data displacement is defined as the maximum displacement, and the volume variation is defined as a value obtained by integrating the resultant displacement distribution.

As is apparent from FIG. 13, the influence of the electrode depth on the maximum displacement tends to become low compared with the influence over the volume variation. If the electrode depth d is ±30% of the set value from the results of the experiments, then the maximum displacement and the change in the volume fall within a change rate of about 5%. It is necessary to stably produce pressure in terms of the stability of droplet injection in the droplet jet apparatus of the present invention and the stability of droplet injection between droplet jet apparatus. For stable pressure, the maximum displacement of and volume variation in each wall made of the piezoelectric material may preferably fall within 5%. To this end, it is considered that the accuracy of the electrode depth makes it necessary to fall within a range of ±30% of the set value.

Thus, the accuracy of the electrode depth was set to fall within the range of ±30% in the droplet jet apparatus according to the present embodiment. As a result, the droplet jet apparatus capable of stably injecting droplets therefrom was obtained.

Having now fully described the invention, it will be apparent to those skilled in the art that many changes and modifications can be made without departing from the spirit or scope of the invention as set forth in the appended claims.

What is claimed is:

1. An ink jet apparatus comprising:

a first plate comprising a piezoelectric actuator plate having a plurality of grooves formed by spaced upstanding sidewalls having opposed sides, said sidewalls each having an electrode formed on both sides thereof; and a second plate coupled to said first plate, said grooves of said first plate and said second plate defining ink channels delineated at least by said sidewalls that act as pressure chambers deformable upon selective application of voltage to each said electrode, wherein each said electrode has a variable depth that varies within a range between at most ±30% of a set electrode depth value, said variable depth extending in a direction parallel to said upstanding sidewall.

2. The ink jet apparatus of claim 1 wherein each said electrode has non-uniform thickness and a thinnest part of said electrode has a minimum thickness of greater than or equal to 0.04 μm.

3. The ink jet apparatus of claim 1 wherein each of said sidewalls has a width and each said electrode has a thickness, wherein a ratio of said thickness to said width is 1:50 or less.

4. The ink jet apparatus of claim 1 wherein each said electrodes has a relative density of at least 70% or more.

5. The ink jet apparatus of claim 1 wherein each said electrode has a non-uniform thickness and a thickness distribution of between at most ±50% of an average film thickness of said electrode.

6. The ink jet apparatus of claim 1 wherein each said electrode has a purity of 99% or more.

7. An ink jet apparatus comprising:

a first plate comprising a piezoelectric actuator plate having a plurality of grooves formed by spaced upstanding sidewalls having opposed sides, said sidewalls each having an electrode formed on both sides thereof; and a second plate coupled to said first plate, said grooves of said first plate and said second plate defining ink channels delineated at least by said sidewalls that act as pressure chambers deformable upon selective application of voltage to each said electrode, wherein each said electrode has a non-uniform thickness with a thinnest part of said electrode having a minimum thickness of 0.04 μm, wherein each of said sidewalls has a width and each said electrode has a thickness, wherein a ratio of said thickness to said width is 1:50 or less, and wherein each said electrode has a non-uniform thickness distribution of between at most ±50% of an average film thickness of said electrode.

8. The ink jet apparatus of claim 7 wherein each said electrode has a relative density of at least 70% or more.

9. The ink jet apparatus of claim 7 wherein each said electrode has a purity of 99% or more.

10. An ink jet apparatus comprising:

a first plate comprising a piezoelectric actuator plate having a plurality of grooves formed by spaced upstanding sidewalls having opposed sides and a width, said sidewalls each having an electrode having a non-uniform thickness formed on both sides thereof; and a second plate coupled to said first plate, said grooves of said first plate and said second plate defining ink channels delineated at least by said sidewalls that act as pressure chambers deformable upon selective application of voltage to each said electrode, wherein a ratio of said thickness of each said electrode to said width of each of said sidewalls is 1:50 or less, and wherein each said electrode has a relative density of at least 70% or more.

11. The ink jet apparatus of claim 10 wherein each said electrode has a thickness distribution of between at most ±50% of an average film thickness of said electrode.

12. The ink let apparatus of claim 10 wherein each said electrode has a purity of 99% or more.

13. An ink jet apparatus comprising:

a first plate comprising a piezoelectric actuator plate having a plurality of grooves formed by spaced upstanding sidewalls having opposed sides, said sidewalls each having an electrode having a non-uniform thickness formed on both sides thereof; and a second plate coupled to said first plate, said grooves of said first plate and said second plate defining ink channels delineated at least by said sidewalls that act as pressure chambers deformable upon selective application of voltage to each said electrode, wherein a thickness distribution of each said electrode is between at most ±50% of an average film thickness of each electrode.

14. The ink let apparatus of claim 13 wherein each said electrodes has a purity of 99% or more.

15. An ink jet apparatus comprising:

a first plate comprising a piezoelectric actuator plate having a plurality of grooves formed by spaced upstanding sidewalls each having opposed sides and a width, said sidewalls each having an electrode having a non-uniform thickness formed on both sides thereof; and a second plate coupled to said first plate, said grooves of said first plate and said second plate defining ink channels delineated at least by said sidewalls that act as pressure chambers deformable upon selective application of voltage to each said electrode, wherein each said electrode has a purity of 99% or more, a relative density of at least 70% or more, a thickness distribution of between at most ±50% of an average film thickness of said electrode, a depth that varies within a range of between at most ±30% of a set electrode depth value, said depth extending in a direction parallel to said upstanding wall, a thinnest part of said nonuniform thickness of said electrode having a minimum thickness of greater than or equal to 0.04 μm, and a ratio of said thickness to said width of 1:50 or less.

* * * * *